US007871086B2

(12) United States Patent
Zampieri

(10) Patent No.: US 7,871,086 B2
(45) Date of Patent: Jan. 18, 2011

(54) SKATE WITH IN-LINE ROLLERS OR ICE BLADES

(75) Inventor: Claudio Zampieri, Tombolo (IT)

(73) Assignee: Nordica S.p.A., Trevignano (Treviso) (IT)

( * ) Notice: Subject to any disclaimer, the term of this patent is extended or adjusted under 35 U.S.C. 154(b) by 944 days.

(21) Appl. No.: 11/664,835

(22) PCT Filed: Sep. 15, 2005

(86) PCT No.: PCT/EP2005/054592

§ 371 (c)(1),
(2), (4) Date: Apr. 6, 2007

(87) PCT Pub. No.: WO2006/037718

PCT Pub. Date: Apr. 13, 2006

(65) Prior Publication Data

US 2008/0067763 A1 Mar. 20, 2008

(30) Foreign Application Priority Data

Oct. 7, 2004 (IT) ..... PN2004A0069

(51) Int. Cl.
*A63C 17/00* (2006.01)

(52) U.S. Cl. ..... 280/11.221; 280/11.224; 280/11.231

(58) Field of Classification Search ..... 280/11.19, 280/11.221, 11.223, 11.224, 11.225, 11.231, 280/11.232
See application file for complete search history.

(56) References Cited

U.S. PATENT DOCUMENTS 1,228,544 A * 6/1917 Falstrem et al. ..... 280/11.15
1,603,588 A * 10/1926 Eberle ..... 280/11.15
1,702,316 A * 2/1929 Ridgers ..... 280/11.14
1,751,692 A * 3/1930 Fruhbeis ..... 280/11.15
1,789,182 A * 1/1931 Klevstad ..... 280/11.15
2,093,915 A * 9/1937 Klevstad ..... 280/11.14
4,272,090 A * 6/1981 Wheat ..... 280/11.231
5,135,244 A * 8/1992 Allison ..... 280/11.28
5,342,071 A * 8/1994 Soo ..... 280/11.207
5,405,156 A * 4/1995 Gonella ..... 280/11.28

(Continued)

FOREIGN PATENT DOCUMENTS

EP 1 066 863 A1 1/2001

*Primary Examiner*—J. Allen Shriver, II
*Assistant Examiner*—Jacob Meyer
(74) *Attorney, Agent, or Firm*—Sughrue Mion, PLLC

(57) ABSTRACT

The present invention refers to a skate with in-line rollers or ice-skating blades, comprising: a boot provided with a sole comprising a heel portion, a central portion and a toe portion; a chassis acting as a support for said sole to rest thereupon, and including a first carriage and a second carriage that are capable of moving relative to each other and adapted to support at least a front roller or blade and at least a rear roller or blade respectively; the first carriage comprises a first plate for said heel portion to rest thereupon, from which there extends towards the front portion of the skate a first arm that is adapted to support at least said front roller or blade, and the second carriage comprises a second plate for the toe portion to rest thereupon, from which there extends towards the rear portion of the skate a second arm that is adapted to support at least said rear roller or blade; the first and second carriages overlap each other approximately at the central portion of the sole.

17 Claims, 4 Drawing Sheets

U.S. PATENT DOCUMENTS 5,503,413 A * 4/1996 Belogour ..... 280/11.225
5,582,418 A * 12/1996 Closser ..... 280/11.225
5,586,774 A * 12/1996 Dentale ..... 280/11.225
5,704,620 A * 1/1998 Oliemans et al. ..... 280/11.225
5,791,665 A * 8/1998 Mayer, II ..... 280/11.226
5,797,608 A * 8/1998 Haldemann ..... 280/11.3
5,842,706 A * 12/1998 Chang ..... 280/11.28
5,887,898 A * 3/1999 Petrosino ..... 280/825
5,890,724 A * 4/1999 Gignoux et al. ..... 280/11.28
5,904,359 A * 5/1999 Caeran et al. ..... 280/11.15
5,904,360 A * 5/1999 Oliemans et al. ..... 280/11.28
5,927,728 A * 7/1999 Gignoux et al. ..... 280/11.211
5,951,027 A * 9/1999 Oyen et al. ..... 280/11.225
5,957,470 A * 9/1999 Powell ..... 280/11.224
5,961,131 A * 10/1999 Hilgarth ..... 280/11.231
5,979,916 A * 11/1999 Gatel et al. ..... 280/11.224
6,007,075 A * 12/1999 Shum ..... 280/11.12
6,015,157 A * 1/2000 Hilgarth ..... 280/11.27
6,017,041 A * 1/2000 Gignoux ..... 280/11.231
6,098,997 A * 8/2000 Cheng ..... 280/11.28
6,120,040 A * 9/2000 Svensson et al. ..... 280/11.224
6,158,748 A * 12/2000 Caeran ..... 280/11.231
6,196,557 B1 * 3/2001 Gerard ..... 280/11.28
6,209,889 B1 * 4/2001 Alfieri et al. ..... 280/11.224
6,227,550 B1 * 5/2001 Maggiolo ..... 280/11.223
6,227,551 B1 * 5/2001 Roy ..... 280/11.223
6,267,389 B1 * 7/2001 Veltmeyer ..... 280/11.224
6,270,088 B1 * 8/2001 Tlucko ..... 280/11.221
6,299,182 B1 * 10/2001 Powell ..... 280/11.222
6,325,394 B1 * 12/2001 Svensson et al. ..... 280/11.216
6,375,198 B1 * 4/2002 Caeran et al. ..... 280/11.221
6,422,579 B1 * 7/2002 Lindblad ..... 280/11.26
6,478,313 B1 * 11/2002 Gray ..... 280/11.223
6,481,726 B2 * 11/2002 Alfieri et al. ..... 280/11.224
6,485,034 B1 * 11/2002 Chou ..... 280/11.28
6,491,309 B1 * 12/2002 Sheldon ..... 280/11.27
6,557,864 B1 * 5/2003 Lenoir ..... 280/11.221
6,561,525 B1 * 5/2003 Chou ..... 280/11.221
6,666,463 B2 * 12/2003 Svensson et al. ..... 280/11.224
6,736,412 B1 * 5/2004 Krah ..... 280/11.224
6,921,093 B2 * 7/2005 Svensson et al. ..... 280/11.224
7,419,187 B2 * 9/2008 Haugen et al. ..... 280/841
2002/0017764 A1 * 2/2002 Svensson et al. ..... 280/11.224
2002/0125658 A1 * 9/2002 Alwarid ..... 280/11.211
2002/0163147 A1 * 11/2002 Svensson et al. ..... 280/11.231
2004/0135328 A1 * 7/2004 Svensson et al. ..... 280/11.224
2005/0280221 A1 * 12/2005 Haugen et al. ..... 280/11.221
2006/0038362 A1 * 2/2006 Svensson et al. ..... 280/11.221

* cited by examiner

SKATE WITH IN-LINE ROLLERS OR ICE BLADES

FIELD OF THE INVENTION

The present invention refers to a skate provided with at least two rollers in an axially in-line arrangement relative to the skate, or an ice skate provided with at least two blades. The skate comprises a chassis for supporting the rollers, or the blades, which includes first and second rolling or sliding units, or carriages as they will be generally referred to hereinafter, that are movable relative to each other.

BACKGROUND OF THE INVENTION

Some kinds of skates, mainly with in-line rollers, are already known in the art to be provided with a chassis including two carriages that are movable relative to each other. So, for instance, the French patent application No. 96 01439 discloses a skate with four in-line rollers mounted in a two-by-two arrangement to a front carriage and a rear carriage, respectively. The two carriages are pivotally hinged on to a chassis, on which the footwear thereabove is intended to rest. The two carriages cross each other in the central zone of the skate, such that the rear roller of the front carriage comes to lie behind the front roller of the rear carriage. This solution, although proving particularly advantageous in enabling small obstacles as may be found on the skating surface to be surmounted, involves a considerable instability of the skate during regular skating, wherein such instability of the skate turns out as being particularly marked during the initial and final pushing phases of a skating stride, i.e. when the skate starts being pushed and then stops being pushed. In the initial pushing phase, the skater exerts a progressive force from the heel portion towards the toe portion, whereas in the terminal pushing phase, such force is solely exerted on the toe portion by tipping, i.e. inclining the skate forwards so as to enable the leg to perform a complete stride. In the skate as described in the French patent application No. 96 01439 it therefore occurs that, during the initial pushing phase, the force exerted onto the heel portion is transferred—via the pivoting connection of the rear carriage to the chassis—to the second and the fourth roller belonging to the rear carriage; thereupon, the force is transferred from the heel portion to the toe portion and, thus, from the second and the fourth roller to the first and third roller belonging to the front carriage. Therefore, the rear carriage progressively changes from a situation in which it is subjected to maximum load (i.e. initial thrust), to a situation in which it on the contrary is fully unloaded, possibly even raised from the ground (end of thrust), and vice-versa as far as the behaviour of the front carriage is concerned. This practically means that, at any moment throughout skating, one of the two carriages is not being loaded adequately, with the possibility for it to freely pivot about the hinging pin connecting it to the chassis in the initial and final thrust phases. This obviously involves the skater being substantially unable to adequately control the carriage not being loaded, and this is exactly what determines the afore-mentioned instability of the skate, particularly when skating at a high speed.

The solution depicted in the U.S. Pat. No. 6,227,550 is only partially effective in solving the above-mentioned instability problem, since the rear and front carriages, connected in an articulated manner to the chassis and supporting a respective pair of alternately arranged rollers, wherein the first and third rollers are supported by the front carriage and the second and fourth rollers are supported by the rear carriage, have arms connected to the chassis via a vibration damping member interposed therebetween. In this manner, the oscillation of the carriages under no-load conditions, i.e. when no force is applied from the foot of the skater, is controlled and kept within limits by said vibration damping members. However, owing to the arms of the carriages being so connected to the chassis, the way in which such embodiment operates is more similar to the one of conventional rigid chassis, in which the rollers are supported by the vertical walls of the chassis. In fact, during the initial pushing phase, it is the rear roller that is in contact with the running or sliding surface, whereas this is true for the front roller during the final thrust phase.

The U.S. Pat. No. 5,904,359 discloses a skate, in which both the sole of the footwear, i.e. boot, and the chassis are comprised of two parts that are movable relative to each other; to the rear part of the sole there is in fact rigidly connected the rear part of the chassis, and the same applies to the respective front parts. The two parts of the sole are joined in an articulated manner to each other, whereas the two parts of the chassis are connected to each other slidably. In this way, the structure of the boot follows the natural bending motion of the foot, thereby keeping at least two rollers in contact with the running or sliding surface throughout the skating stride, i.e. from the beginning to the end thereof. However, in the initial pushing phase and the end-of-thrust phase it is the two rear rollers and the two front rollers, respectively, that are in contact with the running surface. This most obviously involves a clear difficulty in riding, directing and controlling the skate in said phases: in fact, the sole rear rollers being in contact in the initial pushing phase is instrumental in determining a condition of instability of the toe portion exactly when the maximum force is being applied, whereas the sole front rollers being on the contrary in contact during the final phase causes again a condition of instability to arise in the toe portion due to no rest, i.e. backing, being available at the rear when the force applied by the foot is eventually fully removed.

SUMMARY OF THE INVENTION

It therefore is a main object of the present invention to effectively do away with the above-cited drawbacks of prior-art solutions by providing a skate with in-line rollers or ice-skating blades, comprising a chassis for supporting the rollers, or the blades, which includes first and second carriages that are both capable of moving relative to each other, wherein directing, driving and controlling the skate can be ensured in an optimum manner throughout the skating stride, and in particular during the initial pushing and final phases thereof, thereby eliminating or at least drastically reducing the instability of the same skate.

Within the above general object, a purpose of the present invention is to provide a skate that is capable of keeping its rollers, or blades, in contact with the running or sliding surface for a sensibly longer period of time during the skating stride, so as to ensure a greater efficiency to the pushing force being applied.

A further purpose of the present invention is to provide a skate enabling the natural bending motion of the foot to be followed during the skating stride, thereby enhancing both the stability and the control of the same skate.

A by no way less important purpose of the present invention is to provide a skate that can be manufactured at competitive costs using generally known and readily available tools and machinery.

According to the present invention, these aims, along with further ones that will be apparent in the following description, are reached in a skate with in-line rollers or ice-skating blades, incorporating the characteristics and features as recited in the appended claim 1.

BRIEF DESCRIPTION OF THE DRAWINGS

Anyway, features and advantages of the skate according to the present invention will be more readily understood from the description of some particular, although not sole embodiments that is given below by way of non-limiting example with reference to the accompanying drawings, in which.

DETAILED DESCRIPTION OF THE PREFERRED EMBODIMENTS

Figure 1:
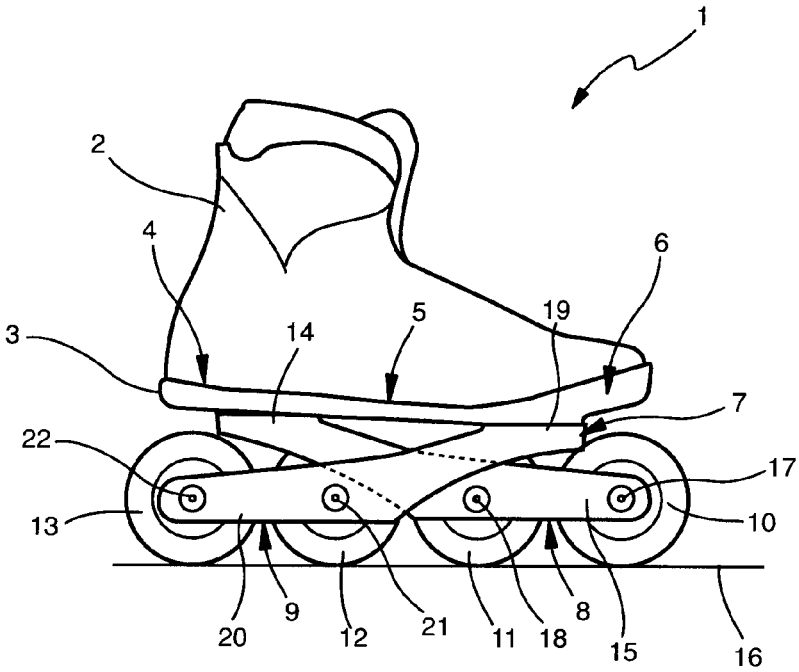
FIG. 1 is a side view of a skate according to the present invention.

With reference to the above-cited Figures, the reference numeral 1 is used there to indicate a skate that comprises a boot or footwear item 2 provided with a sole 3 comprising a heel portion 4, a central portion 5 and a toe portion 6. The skate 1 further comprises a chassis 7, on which there is resting the sole 3 as fixedly connected in a largely known manner thereto. The chassis 7 includes a first carriage 8 and a second carriage 9 that are capable of moving relative to each other and adapted to support at least a roller 10, 13, respectively. Preferably, each carriage 8, 9 supports a pair of rollers, in which the first carriage 8 supports a first pair of rollers 10, 11 and the second carriage 9 supports a second pair of rollers 12, 13, respectively, said rollers being referred to as first roller 10, second roller 11, third roller 12 and fourth roller 13 hereinafter.

The first carriage 8 has a first plate 14, to which there is attached the heel portion 4 of the sole 3 so that it can rest thereupon, and a first arm 15 that extends downwards, toward the running surface 16, and longitudinally toward the front portion of the skate 1, reaching substantially up to the toe portion 6. This first arm 15 is adapted to support, at respective transversal axes 17 and 18 spaced longitudinally from each other, the first roller 10 and the second roller 11.

Similarly, the second carriage 9 has a second plate 19, to which there is attached the toe portion 6 of the sole 3 so that it can rest thereupon, and a second arm 20 that extends downwards, toward the running surface 16, and longitudinally toward the rear portion of the skate 1, reaching substantially up to the heel portion 4. This second arm 20 is adapted to support, at respective transversal axes 21 and 22 spaced longitudinally from each other, the third roller 12 and the fourth roller 13.

With the configuration described above, therefore, the first carriage 8 and the second carriage 9 are so shaped and arranged as to cross each other approximately at the central portion 5 of the sole 3, and to support the plurality of rollers 10, 11, 12, 13 according to an in-line arrangement extending roughly parallel to the longitudinal extension of the skate 1.

The innovatory concept embodied in the skate according to the present invention, and the way it actually works, lies thus in transferring to the front rollers, via the first carriage 8, the pushing force generated by the pressure exerted by the heel 4 onto the first plate 14 during the initial phase of the skating stride, wherein the first roller 10 and the second roller 11 have the main task of ensuring the directionality of the skate in view of its ability to follow the skating trajectory, i.e. course in an optimum manner. Then, the force is gradually transferred—owing to the exerted pressure gradually shifting from the heel 4 to the toe portion 6 and, as a result, from the first plate 14 to the second plate 19—to the rear rollers, so that—at the end of the skating stride—these are fully loaded, i.e. under full load conditions, owing to the pressure generated by the toe portion 6 pressing upon the second plate 19. The rear rollers, i.e. the third roller 12 and the fourth roller 13, have substantially the task of ensuring the skater with a reliable foothold at the back for a better control of the skate during the final phase of the skating stride.

As a result of the two carriages 8 and 9 being capable of moving relative to each other during the skating stride, the contact of the rollers with the running surface 16 is substantially extended all along the arc described by the trajectory of the skate during the skating stride performed by the skater. In fact, owing to the pushing force being transferred from the pressing portions of the sole to the rollers so that are able to perform their tasks in an optimum manner at each instant throughout the skating stride, the rollers themselves—thanks to the respective carriages being able to move relative to each other—are effectively enabled to keep in contact with the running surface for considerably longer a period of time, in that they engage said surface with the front rollers as soon as the initial pushing phase of the skating stride begins, and keep then in contact therewith with the rear rollers up to the end of the pushing phase.

Fully apparent from the above description is therefore the ability of the skate to the present invention to effectively reach the aims and advantages cited afore. In fact, the way in which the skate can be driven, directed and controlled throughout the skating stride, i.e. at each phase thereof and, in particular, during the phases in which the skater starts and then stops pushing, is effectively optimized thanks to both the rollers being capable of remaining in contact with the running surface for a prolonged period of time that substantially extends all along the arc described by the trajectory of the skating stride, and the pushing force being transferred from the instant pressing portion, i.e. heel portion, central portion or toe portion of the sole, as the case may be depending on the particular instant within the skating stride—exactly to the rollers that are required to perform the instant task that is best suited to improve the efficiency of the skating stride.

Further advantages of the skate made according to the present invention derive from an increased efficiency, i.e. yield of the pushing force being applied, owing to the markedly longer time during which the rollers are in contact with the running surface throughout the skating stride, as well as the elimination of or, anyway, a drastic reduction in the instability of the skate thanks to the fact that it is the most appropriate rollers that engage the running surface at each phase throughout the skating stride, actually.

It will be readily appreciated that the inventive skate according to the present invention as described to illustrative purposes hereinbefore may be subject to a number of different embodiments and modifications without departing from the scope of the present invention.

Figure 2:
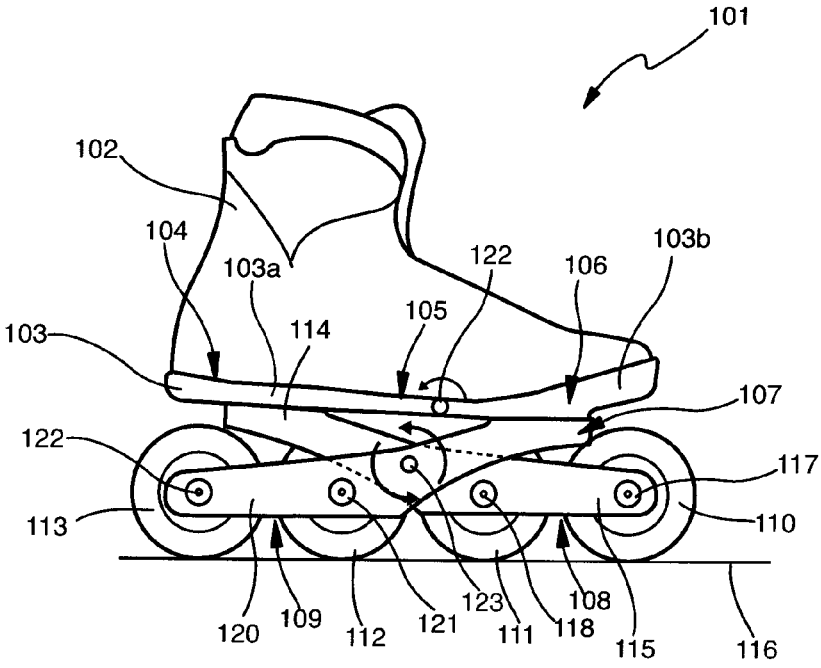
FIG. 2 is a side view, similar to that of FIG. 1, of a second embodiment of a skate according to the present invention.

So, for instance, FIG. 2 illustrates a second embodiment in which, in view of further enhancing both skate control and skating efficiency, the sole 103 of the footwear item 102 is made so as to be pliable, i.e. capable of bending, so as to be able to follow the natural motion of the foot during the skating stride, and the first carriage 108 is connected to the second carriage 109, while anyway maintaining the capability of moving relative to each other.

To such purpose, the sole 103 is made so as to be comprised of a rear part 103*a*, which includes the heel portion 104 and the rear portion of the central portion 105, and a front part 103*b*, which includes the front portion of the central portion 105 and the toe portion 106, said two parts being pivotally connected to each other by means of first hinge means 122 that are advantageously positioned in the central portion 105 at a site approximately corresponding to the articulation zone of the foot.

To the first carriage 108 there is attached the rear part 103*a* of the sole 103, whereas the front part 103*b* thereof is attached to the second carriage 109, wherein the two carriages 108 and 109 are pivotally connected to each other at the crossing zone thereof by means of second hinge means 123.

As an alternative thereto, the sole 103 may be made integrally as a unitary piece that is capable of yielding elastically at the central portion 105 thereof.

Figure 3:
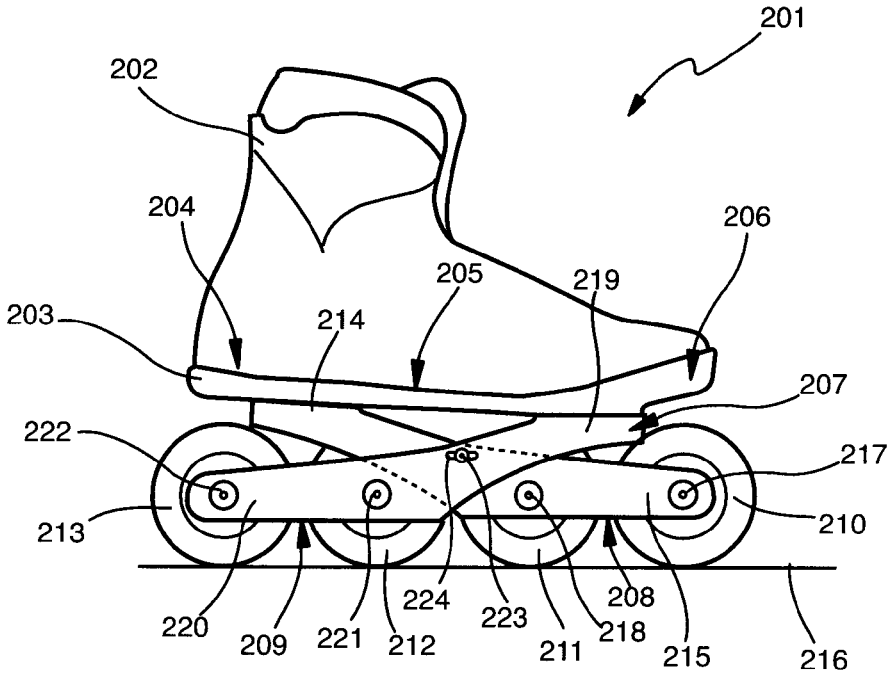
FIG. 3 is a side view, similar to the previous ones, of a third embodiment of a skate according to the present invention.

FIG. 3 illustrates a third embodiment of the skate according to the present invention, in which the sole 203 is preferably rigid; the first carriage 208 and the second carriage 209 are pivotally and slidably connected to each other by means of a pin-and-slot arrangement 223, 224.

Figure 4:
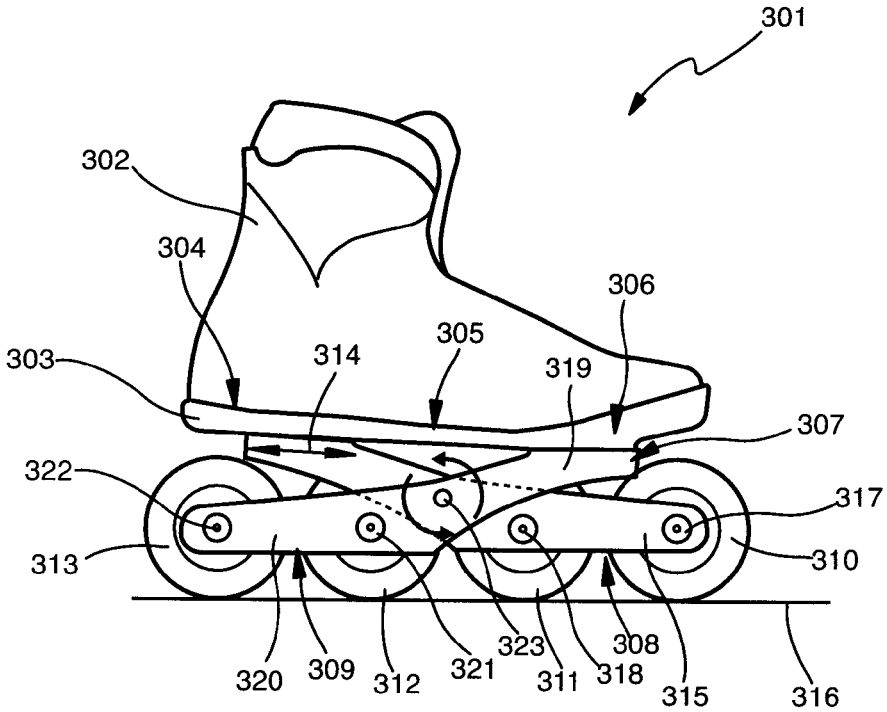
FIG. 4 is a side view, similar to the previous ones, of a fourth embodiment of a skate according to the present invention.

Shown in FIG. 4 is a fourth embodiment of the skate according to the present invention, this fourth embodiment being substantially similar to the previous one, except for the fact that the above-mentioned pin-and-slot arrangement is in this case subdivided into a hinge 323, ensuring the pivoting connection between the first carriage 308 and the second carriage 309, and a sliding coupling between the first plate 314 and the sole 303 at the heel portion 304. As an alternative thereto, such sliding coupling may be provided between the second plate 319 and the toe portion 306.

Figure 5:
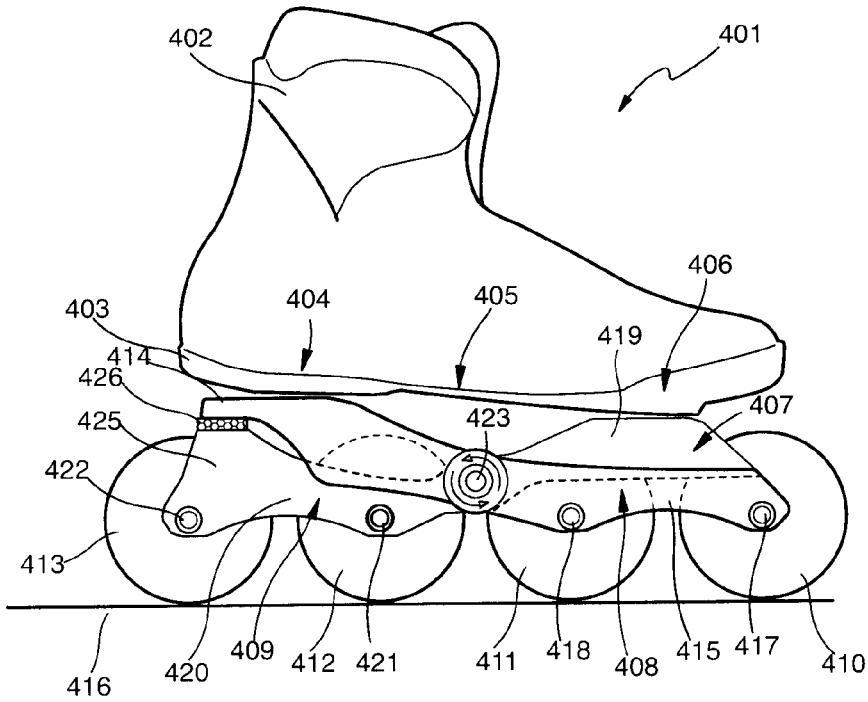
FIG. 5 is a side view, similar to the previous ones, of a fifth embodiment of a skate according to the present invention.

The illustration in FIG. 5 refers to a fifth embodiment of the skate according to the present invention, in which at least one of the first carriage 408 and the second carriage 409 is provided with an appendix extending upwards from the first arm 415 or the second arm 420, as the case may be, to interact with the second plate 419 or the first plate 414, respectively, via at least an elastic or vibration-damping member interposed therebetween. The two carriages 408 and 409 are coupled to each other by means of a hinge 423, and the sole 403 may be either rigid or pliable, either elastically or by means of a hinge in accordance with what has been illustrated and described in connection with the embodiment shown in FIG. 2. It will be readily appreciated that a number of different options are feasible to implement such connection between the carriages 408 and 409, according to what has been described with reference to the other embodiments illustrated hereinbefore.

In the case of the embodiment shown in FIG. 5, the second carriage 409 is provided with the appendix 425, which interacts, via the elastic or vibration-damping member 426 interposed therebetween, with the first plate 414 of the first carriage 408 at the heel portion 404.

With a configuration as described above, part of the pushing force is transferred from the pressing zone, i.e. the heel portion 404 in the case being described, also to the rear rollers 412 and 413 so as to achieve a greater contact area with the running surface in the initial pushing phase.

Similarly, in the case that the interaction between the first carriage 408 and the second carriage 409 takes place in the toe portion 406, a greater contact area of the rollers with the running surface in the initial pushing phase is again ensured.

Figure 6:
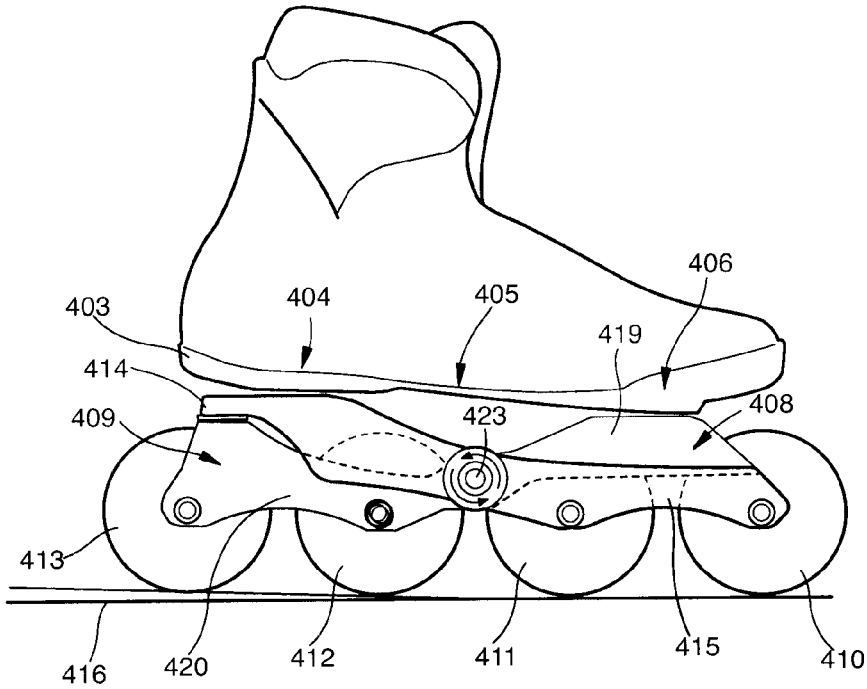
FIG. 6 is a view of the skate of FIG. 5 in the initial pushing phase of the skating stride (force exerted upon the heel portion)
Figure 7:
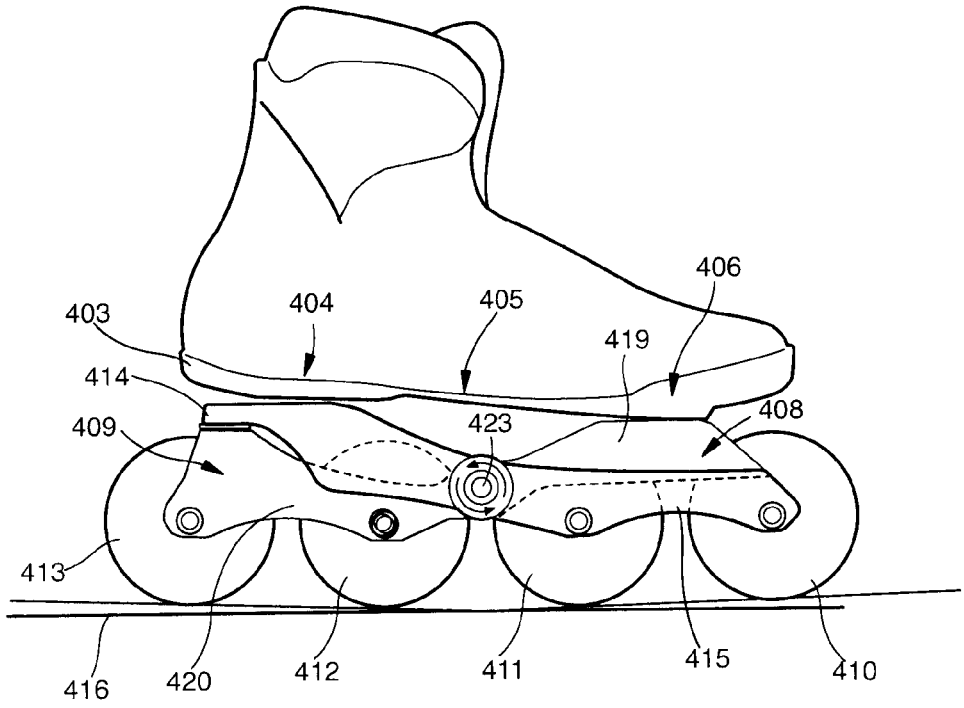
FIG. 7 is a view of the skate of FIG. 5 in the intermediate pushing phase of the skating stride (force exerted upon the central portion of the foot)
Figure 8:
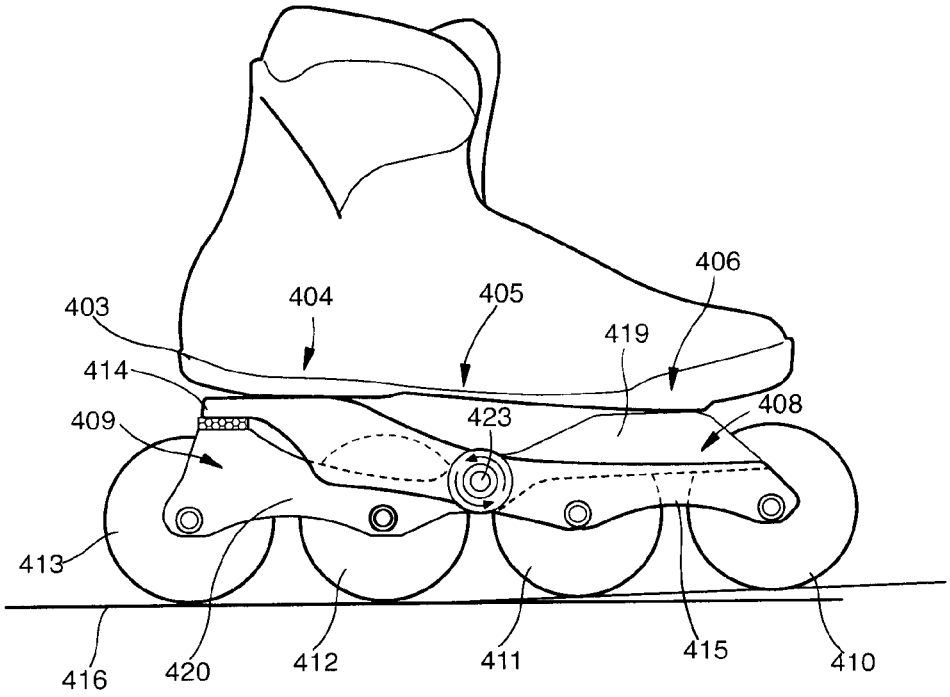
FIG. 8 is a view of the skate of FIG. 5 in the final pushing phase of the skating stride (force exerted upon the toe portion).

FIGS. 6, 7 and 8 illustrate the configuration of the rollers relative to the running surface 416 in the various pushing phases during the skating stride. In the initial pushing phase, which is illustrated in FIG. 6, the pressure imparted from the heel portion 404 to the first carriage 408 is transferred in the form of pushing force, i.e. thrust, to the front rollers 410 and 411 and, in part, also to the third roller 412; in the intermediate pushing phase of the skating stride, as shown in FIG. 7, it is the central rollers 411 and 412 that engage the running surface 416, since the pressing zone is in this case the central portion 405 of the sole 403, thereby favouring an arc-shaped trajectory of the skate; finally, FIG. 8 illustrates the final pushing phase, in which the pressure imparted from the toe portion 406 to the second carriage 409 is transferred in the form of pushing force, i.e. thrust, to the rear rollers 412 and 413 and, in part, also to the second roller 411.

A further advantage of the skate according to the present invention, and in particular of the embodiment thereof illustrated in FIG. 5, derives from a smaller extent of sliding friction of the rollers on the running surface, which in turn results in a far smoother movement, i.e. greater slidability thereof owing to the rollers engaging the running surface in an optimum manner when describing the trajectory arc of the skate during the pushing stride. Again, this results in the rollers being subject to much less wear.

While it is a skate with in-line rollers that has been described above, the basic innovatory concept of the present invention equally applies to an ice skate, in which the rollers are replaced by at least a first and a second blade as supported by the first and the second carriage, respectively.

It shall be appreciated that the materials used to manufacture the various parts of the inventive skate, as well as the shapes and the sizing thereof, may each time be selected so as to more appropriately meet the particular requirements or suit the particular application.

The invention claimed is:

1. A skate with in-line rollers, comprising:

a boot or footwear item provided with a sole comprising a heel portion, a central portion, and a toe portion;

a chassis acting as a support for said sole to rest thereupon, and including a first carriage and a second carriage that are capable of moving relative to each other;

at least two front rollers provided at said toe portion and at least two rear rollers provided at said heel portion; and said first carriage comprises a first plate for said heel portion to rest thereupon, from which there a first arm extends towards a front portion of said skate reaching up to said toe portion, said first arm supporting said at least two front rollers, and said second carriage comprises a second plate for said toe portion to rest thereupon, from which a second arm extends towards a rear portion of said skate reaching up to said heel portion, said second arm supporting said at least two rear rollers; and said first and said second carriage overlapping each other approximately at the central portion of said sole.

2. The skate according to claim 1, wherein said heel portion is attached to said first plate, said first arm extending downwards towards a running surface and longitudinally towards said toe portion, and said first arm supporting, at respective transverse axes thereof that are spaced longitudinally from each other, said at least two front rollers.

3. The skate according to claim 1, wherein said toe portion is attached to said second plate, said second arm extending downwards towards a running surface and longitudinally towards said heel portion, and said second arm supporting, at respective transverse axes thereof that are spaced longitudinally from each other, said at least two rear rollers.

4. The skate according to claim 1, wherein said sole is capable of bending.

5. The skate according to claim 4, wherein said sole is made as a unitary piece that is capable of yielding elastically at least at said central portion.

6. The skate according to claim 4, wherein said sole comprises a rear part and a front part that are pivotally connected to each other by means of a first hinge.

7. The skate according to claim 6, wherein said rear part includes said heel portion and a rear part of said central portion, and said front part includes a front part of said central portion and said toe portion.

8. The skate according to claim 7, wherein said first hinge is positioned in said central portion at a site corresponding roughly to an articulation zone of a foot.

9. The skate according to claim 1, wherein said first carriage is movably connected to said second carriage approximately in the area where the first carriage and the second carriage overlap each other.

10. The skate according to claim 9, wherein said first and said second carriage are pivotally connected to each other by means of a second hinge.

11. The skate according to claim 10, wherein at least one of said first and second carriages is slidably coupled to at least one of said heel portion and toe portion, respectively.

12. The skate according to claim 1, wherein said first and second carriages are pivotally and slidably connected to each other by means of a pin-and-slot arrangement.

13. The skate according to claim 1, wherein said first and second carriages comprise first and second appendixes extending upwards from said first and second arm, respectively, so as to interact with said second and first plate, respectively, via at least an elastic or vibration damping member interposed therebetween.

14. The skate of claim 1, wherein the rollers comprise the at least two front rollers and the at least two rear rollers, wherein all the rollers at the toe portion are supported by the first arm and all the rollers at the heel portion are supported by the second arm.

15. The skate of claim 14, wherein the total number of rollers is four.

16. A method for transferring pushing force in a skate comprising a boot or footwear item provided with a sole comprising a heel portion, a central portion and a toe portion, at least two front rollers provided at said toe portion and at least two rear rollers provided at said heel portion, and a chassis acting as a support for said sole to rest thereupon, the chassis including a first carriage and a second carriage that are capable of moving relative to each other, the method comprising:

providing the first carriage comprising a first plate for said heel portion to rest thereupon and a first arm that supports said at least two front rollers, so as to transfer force from a first pressing portion located on a rear side of said skate to said at least two front rollers; and providing the second carriage comprising a second plate for said toe portion to rest thereupon and a second arm that supports said at least two rear rollers, so as to transfer force from a second pressing portion located on a front side of said skate to said at least two rear rollers.

17. The method of claim 16, further comprising:

applying a first force to the first pressing portion;

transferring, in response to the applied first force, the first force to the at least two front rollers;

applying a second force to the second pressing portion; and transferring, in response to the applied second force, the second force to the at least two rear rollers.

* * * * *